US008192142B2

(12) United States Patent
Almstedt et al.

(10) Patent No.: US 8,192,142 B2
(45) Date of Patent: Jun. 5, 2012

(54) STEAM TURBINE

(75) Inventors: Henning Almstedt, Mülheim an der Ruhr (DE); Stefan Essink, Emmerich (DE); Mark-Andre Schwarz, Xanten (DE); Rainer Tamme, Essen (DE); Andreas Ulma, Mülheim an der Ruhr (DE); Kai Wieghardt, Mannheim (DE)

(73) Assignee: Siemens Aktiengesellschaft, München (DE)

( * ) Notice: Subject to any disclaimer, the term of this patent is extended or adjusted under 35 U.S.C. 154(b) by 738 days.

(21) Appl. No.: 11/919,856

(22) PCT Filed: Mar. 8, 2006

(86) PCT No.: PCT/EP2006/060552

§ 371 (c)(1), (2), (4) Date: Mar. 27, 2009

(87) PCT Pub. No.: WO2006/117257

PCT Pub. Date: Nov. 9, 2006

(65) Prior Publication Data

US 2009/0196746 A1 Aug. 6, 2009

(30) Foreign Application Priority Data

May 3, 2005 (EP) ..... 05009709

(51) Int. Cl.
*F01D 21/00* (2006.01)
*F01D 5/08* (2006.01)

(52) U.S. Cl. ..... 415/108; 415/134; 415/176

(58) Field of Classification Search ..... 415/134, 415/116, 144, 108
See application file for complete search history.

(56) References Cited

U.S. PATENT DOCUMENTS

| | | | | |
|---|---|---|---|---|
| 2,402,841 | A * | 6/1946 | Ray | 415/47 |
| 4,642,025 | A * | 2/1987 | Heiniger et al. | 415/139 |
| 4,732,533 | A * | 3/1988 | Remberg et al. | 415/134 |
| 5,388,960 | A * | 2/1995 | Suzuki et al. | 415/176 |
| 6,898,935 | B2 * | 5/2005 | Barber et al. | 60/646 |
| 7,762,764 | B2 * | 7/2010 | Peel | 415/108 |
| 7,766,610 | B2 * | 8/2010 | Busekros et al. | 415/144 |

FOREIGN PATENT DOCUMENTS

| | | | |
|---|---|---|---|
| DE | 852 247 | | 7/1951 |
| DE | 1 812 488 | | 9/1970 |
| DE | 1812488 | | 9/1970 |
| DE | 27 39 076 | | 3/1978 |
| DE | 2739076 | A1 | 3/1978 |
| DE | 44 25 352 | A1 | 1/1996 |
| GB | 1529180 | A | 10/1978 |
| JP | 01167403 | A | 7/1989 |
| JP | 03077367 | A | 4/1991 |
| JP | 11093617 | A | 4/1999 |

* cited by examiner

*Primary Examiner* — Steven Loke
*Assistant Examiner* — David Goodwin

(57) ABSTRACT

A steam turbine has a two-shell housing, including an outer casing and an inner casing arranged therein, as well as a pipe that extends through the outer casing for supplying and/or removing steam to or from the inner casing, the pipe being provided with a pair of apertures arranged opposite each other on the inner casing. According to the invention, a first steam supply or discharge pipe can be connected to a first aperture, and the second aperture is closed by a cover.

7 Claims, 1 Drawing Sheet

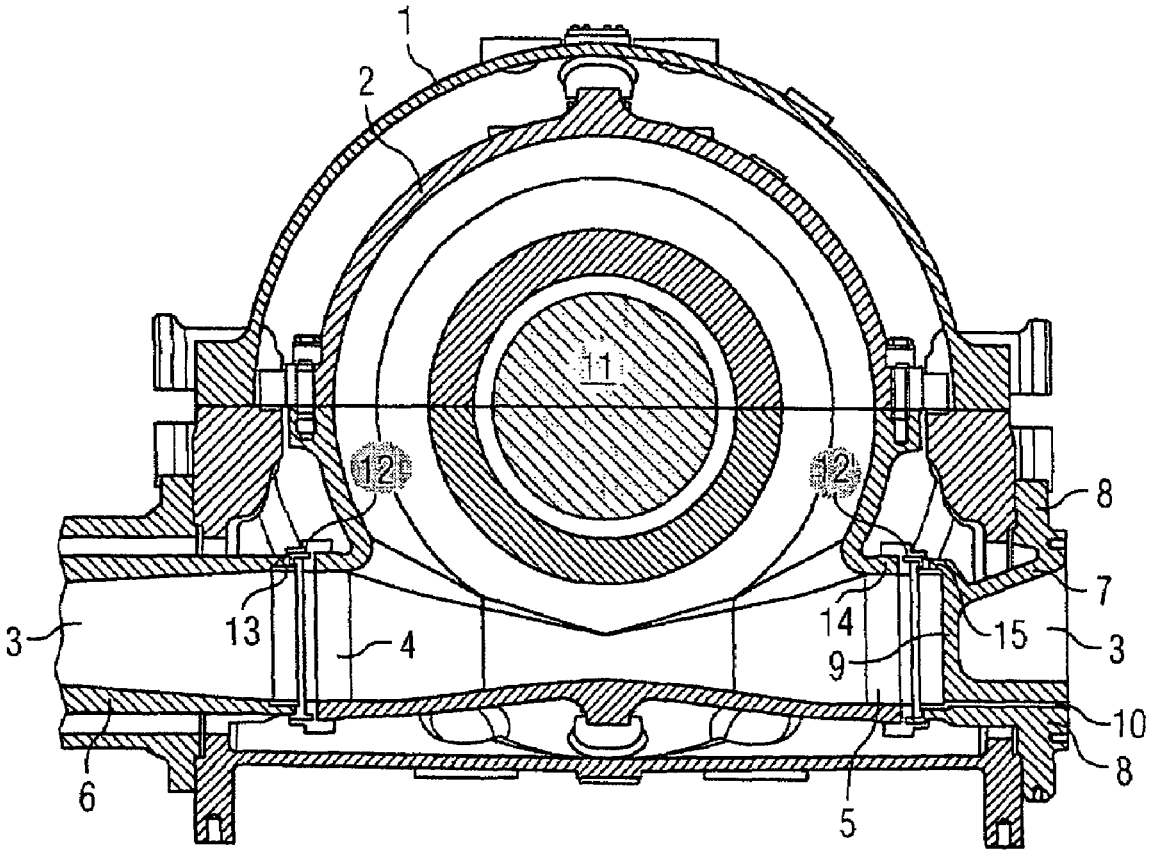
1
2
11
12
12
8
7
3
13
4
14
15
3
9
10
8
6
5

STEAM TURBINE

CROSS REFERENCE TO RELATED APPLICATIONS

This application is the US National Stage of International Application No. PCT/EP2006/060552, filed Mar. 8, 2006 and claims the benefit thereof. The International Application claims the benefits of European application No. 05009709.6 filed May 3, 2005, both of the applications are incorporated by reference herein in their entirety.

FIELD OF INVENTION

The invention relates to a steam turbine with a double-shell casing, which comprises an outer casing and an inner casing which is arranged within it, and with a port, which is guided through the outer casing, for feeding and/or exhausting steam into or from the inner casing, wherein the port is designed with a pair of port openings which are formed opposite each other on the inner casing.

BACKGROUND OF THE INVENTION

A double-shell construction of casings on steam turbines is preferably used if an expansion of live steam or hot reheated steam is carried out in the steam turbine. In this case, the expansion is carried out in the inner casing, which is enclosed by the outer casing which absorbs the expanded steam (exhaust steam). In this way, the inner casing is cooled and at the same time bears the greater part of the pressure, which is especially advisable at high steam pressures. In order to compensate radial or lateral shear forces which are caused by thermal expansions and which lead inter alia to undesired deformations or displacements of the inner casing and consequently disadvantageously affect efficiency and range of application of the steam turbine, a pair of port openings, with associated pipes, is provided in the known steam turbines, which port openings are formed opposite each other on the inner casing. During operation of such a steam turbine, live steam is fed evenly through the pipes to both port openings, as a result of which the shear forces which occur due to feeding steam to the inner casing are basically compensated.

With these known steam turbines, however, the problem arises that feeding steam to the steam turbine via two ports, with a low volumetric flow rate and without corresponding parallel flow at the boiler port, is uneconomical. The use of a steam turbine with only one port opening is then advisable, but, as previously already explained, leads to the occurrence of large radial or lateral shear forces which disadvantageously affects the efficiency and the range of application of the steam turbine. Reduction of the shear forces in the case of a single pipe port can indeed be achieved by the feed pipe being rigidly connected to the inner casing and, for thermally movable passage through the casing, being flexibly connected to the outer casing (for example, via an expansion joint). This attachment, however, requires a costly installation and leads to a direct transfer of pipe deformations to the inner casing, with the risk of bridging the radial clearances which is associated with these deformations.

A turbomachine with a bladed rotor, which rotates in a stator which comprises a lower section and an upper section, is disclosed in DE 27 39 076 A1.

A multi-shell axial turbine with outer casing and inner casing which is split in the axial plane, and also with live steam inserts which are guided through outer and inner casings to the stage chamber in a steam-tight and thermally movable manner, is disclosed in DE 18 12 488 A1.

SUMMARY OF INVENTION

In view of these problems in the prior art, the invention is based, therefore, on the object of providing a steam turbine which operates economically even with low steam volumetric flow, despite the fact that the steam pipe port is to be effected by means of a simple installation, and in which no large shear forces occur during steam inflow.

This object is achieved according to the invention by a steam turbine which is referred to in the introduction, which is characterized in that a pipe for feeding and/or exhausting steam is connectable to a first port opening, and also the second port opening is sealed by a cover. Due to the fact that the port opening which can be provided with the pipe, and the port openings which are sealed by the cover, lie opposite each other in the inner casing, force compensation is brought about in the inner casing during steam inflow through the pipe, similar to when connecting two steam feed pipes to the port openings which lie opposite each other. The occurrence of radial or lateral shear forces is largely prevented as a result. With the steam turbine according to the invention, it is therefore possible to rigidly connect the steam feed pipe to the outer casing, and to design the connection to the inner casing in a flexible manner. Consequently, a simple installation of the steam feed pipe is possible.

Furthermore, it is provided that the cover is designed with a stationary fixing on the outer casing, and with a thermally movable coupling on the inner casing. Such a thermally movable coupling on the inner casing can be created, for example, by fitting the cover onto a projecting pipe end of the port opening, with clearance in the fitting direction. In this case, with thermal deformations of the inner casing, during which the port opening is moved towards the outer casing or away from the outer casing, this relative movement is compensated by the clearance between the cover and the port opening. The cover, however, is fixed on the outer casing in a stationary manner. Since for compensating of the forces which act upon the casing the pipe is advantageously fastened on the oppositely disposed port opening similar to the cover, an especially simple installation of the steam feed pipe results. That is to say, the pipe is also coupled in a thermally movable manner on the inner casing, for example by fitting onto a projecting pipe end at the associated port opening, and is also fixed on the outer casing in a stationary manner. Furthermore, by means of this arrangement, overall an ideal cushioning of pipe deformations results.

In an advantageous embodiment according to the invention, the sealing of the second port opening by the cover is designed in such a way that with an increase of steam pressure in the inner casing with regard to a force action on the inner casing and/or outer casing, the cover basically behaves like the pipe which is connected to the first oppositely disposed port opening. Consequently, optimum force compensation is effected on the inner casing and/or on the outer casing. Due to the fact that the port openings are arranged opposite each other, and consequently the forces which are created on the inner casing as a result of an increase of steam pressure can be basically symmetrically diverted onto the outer casing and the inner casing, the occurrence of shear forces on the inner casing is largely avoided.

In an expedient embodiment according to the invention, the sealing of the second port opening by the cover is designed in such a way that with thermal deformations on the steam turbine with regard to a force action on the inner casing and/or outer casing, the cover basically behaves like the pipe which is connected to the first oppositely disposed port opening. Due to the fact that the port openings are arranged opposite each other, the forces which are induced by thermal deformations on the steam turbine are symmetrically diverted onto the inner casing and/or outer casing, as a result of which shear forces which occur on the inner casing are largely avoided.

Furthermore, it is expedient according to the invention if the cover is basically designed in the shape of a cup. The cup shape structurally represents an approximation to the tubular shape of the pipe. Consequently, the mechanical relationships between steam feed pipe and cover are even better adapted to each other, as a result of which an optimum force compensating action ensues.

In an expedient embodiment, the open edge section of the basically cup-shaped cover is fastened on the outer casing, especially flange-fastened. Consequently, a symmetrical fastening of the cover results with regard to the steam feed pipe which is customarily fastened on the outer casing at an equal distance from the associated port opening. The fastening by means of a flange enables a very secure fixing of the cover on the outer casing, as a result of which the stability of the entire system is increased.

Furthermore, it is advantageous according to the invention if the base section of the basically cup-shaped cover is arranged on the inner casing, especially movably sealed. Consequently, escape of steam, which would significantly lower the efficiency of the steam turbine, is avoided. Even so, the cover remains movable relative to the inner casing, as a result of which thermal expansions of the casing material during steam action are permitted.

In an expedient embodiment according to the invention, a passage for draining the inner casing and/or outer casing is formed in the cover. As a result, condensate which is formed in the inner casing or outer casing can be discharged from the turbine. Standing condensate which remains in the turbine can lead to asymmetrical structures or casing deformations on account of the varying heat transfer. As a consequence, it can even lead to bridging of clearances in extreme circumstances. Since on account of the immediate expansion of the steam when entering the steam turbine a large amount of condensate accrues at the same time, a discharge passage in this region, i.e. in the cover which is located close to the inlet opening which is connected to the pipe, is especially effective for quick discharge of the condensate. Therefore, asymmetric casing deformations can be avoided and the mechanical relationships of rotor to stationary casing can be improved. In this way, radial clearances in the mechanical design can be minimized, which leads to an increase of efficiency.

For achieving the aforementioned object, specifically the provision of a steam turbine in which no large shear forces occur and yet the steam feed is to be effected by means of a simple installation, according to the invention a cover for sealing an opening is additionally provided, which cover is formed for sealing a port opening of a steam turbine with a double-shell casing, which comprises an outer casing and an inner casing which is arranged within it, and with a port, which is guided through the outer casing and has the port opening, for feeding and/or exhausting steam into or from the inner casing. Advantageous embodiments of the cover are provided herein, the advantages which are associated with them result similarly from the preceding statements relating to advantageous developments of the steam turbine according to the invention.

BRIEF DESCRIPTION OF THE DRAWINGS

An exemplary embodiment of the invention, with reference to the schematic drawing, to which reference is explicitly made with regard to all details which are essential for the invention, is explained in the following. In the drawing:

The FIGURE shows a sectional view of an embodiment of a steam turbine according to the invention, with a cover which is fastened on a port opening.

DETAILED DESCRIPTION OF INVENTION

The FIGURE is a sectional view of a steam turbine according to the invention. In its center, there is a shaft 11 which is enclosed by an inner casing 2. This casing can be axially symmetrically constructed, but does not necessarily have to be symmetrical. An outer casing 1, which can also be axially symmetrically constructed, is arranged around the inner casing 2. Via a steam feed pipe 6, live steam or hot reheated steam, or exhaust steam, can be fed or discharged into or from the inner casing 2 under high pressure. The shaft 11 is driven as a result of the ensuing expansion of the steam which is supplied. Consequently, the expanded steam is guided through the cavity between outer casing 1 and inner casing 2, as a result of which cooling of the inner casing is effected.

The steam turbine has a port 3 for feeding and/or exhausting steam into or from the inner casing 2, which port is guided through the outer casing 1 both from the left-hand side and from the right-hand side with regard to the FIGURE. This port 3 has two port openings 4 and 5 opposite each other on the inner casing 2. The port openings 4 and 5 are constructed in each case with a projecting pipe end 13 or 14. The pipe 6 for feeding and/or exhausting steam is attached on the first projecting pipe end 13 of the first port opening 4. The pipe 6 is flange-fastened on the outer casing 1 and consequently is fastened upon it in a stationary manner. Relative movements between inner casing 2 and outer casing 1, both in the radial direction and in the axial direction, which, for example, are caused by thermal deformations of the inner casing 1 and by thermal deformations of the pipe 6, are compensated by a thermally movable seal between the pipe 6 and the first projecting pipe end 13, which in the present case is realized by means of a first L-ring 12.

The second port opening 5, which is opposite the first port opening 4, is provided with a second projecting pipe end 14 which corresponds to the first projecting pipe end 13. A cup-shaped cover 7 is fitted onto the second projecting pipe end. The cup-shaped cover 7 has a base section 9 for sealing the second port opening 5, and also has an open edge section 8. This open edge section 8 is flange-fastened on the outer casing 1. Consequently, the cover 7 is fastened on the outer casing 1 in the same way as the connecting pipe 6, that is to say in a stationary manner.

An annular projection 15 is formed on the underside of the base section 9, i.e. on the outer side of the cup. This annular projection 15 is attached on the second projecting pipe end 14 of the port opening 5. A thermally movable seal for compensating thermal deformations or relative displacements both in the radial direction and in the axial direction between inner casing and outer casing 2 or 1, which are caused by increasing the internal pressure in the inner casing 2, is provided between the annular projection 15 and the second port opening 5. This thermally movable seal is realized in the present case by means of a second L-ring 12'. During the axial displacement between the second projecting pipe end 14 and the annular projection 15 of the cover 7, which occurs as a result of the relative displacements, the sealing of the port opening 5, however, holds good without limitation.

The L-rings 12 or 12' at the same time seal the inner cavity of the inner casing 2 from the interspace between outer casing 1 and inner casing 2. Alternatively to the L-rings 12 or 12', any type of piston rings, or corrugated pipe expansion joints, or any other type of seal, which at the same time seals and also allows relative movements between inner casing and outer casing, can also be used.

Furthermore, the cover 7 has a passage 10 for draining the inner casing. On account of the immediate expansion of the steam which is introduced through the inlet pipe 6 into the inner casing 2 of the steam turbine, an appreciable amount of condensed liquid is formed, which is directed from the inner casing of the steam turbine through the drain passage 10.

The invention claimed is:

1. A steam turbine with a double-shell casing, comprising:

a shaft rotatably arranged concentric with a rotational axis of the turbine;

an inner casing arranged concentric with the shaft;

an outer casing arranged concentric with and surrounding the inner casing;

a port guided through the outer casing for a feeding and/or an exhausting of steam into or from the inner casing, wherein the port is comprises:

a first port opening arranged on the inner casing, a second port opening arranged on the inner casing opposite the first port opening, and a pipe for feeding and/or exhausting steam connected to a first port opening; and a cover that seals the second port opening and having a stationary fixing arranged on the outer casing and a thermally movable coupling on the inner casing.

2. The steam turbine as claimed in claim 1, wherein the cover is fastened in a stationary manner.

3. The steam turbine as claimed in claim 2, wherein the sealing of the second port opening by the cover is such that with thermal deformations on the steam turbine with regard to a force action on the inner and/or outer casing the cover remains fastened in a stationary manner.

4. The steam turbine as claimed in claim 3, wherein the cover is essentially cup shaped having an open edge section and a base edge section.

5. The steam turbine as claimed in claim 4, wherein the open edge section of the cup-shaped cover is flange-fastened on the outer casing.

6. The steam turbine as claimed in claim 5, wherein the base section of the cup-shaped cover is arranged on the inner casing in a movably sealed manner.

7. The steam turbine as claimed in claim 6, wherein the cover further comprises a passage for draining the inner and/or outer casing.

* * * * *